US009452543B2

(12) United States Patent
Supron et al.

(10) Patent No.: US 9,452,543 B2
(45) Date of Patent: Sep. 27, 2016

(54) CUTTER FOR A PRINTER

(75) Inventors: Steven A. Supron, Ithaca, NY (US); David E. Weeks, Willseyville, NY (US); Bruce Harris, Freeville, NY (US)

(73) Assignee: Transact Technologies Incorporated, Hamden, CT (US)

( * ) Notice: Subject to any disclaimer, the term of this patent is extended or adjusted under 35 U.S.C. 154(b) by 1030 days.

(21) Appl. No.: 12/765,911

(22) Filed: Apr. 23, 2010

(65) Prior Publication Data

US 2011/0259163 A1 Oct. 27, 2011

(51) Int. Cl.

| | |
|---|---|
| ***B26D 1/08*** | (2006.01) |
| ***B26D 5/16*** | (2006.01) |
| ***B41J 11/70*** | (2006.01) |
| ***B41J 29/02*** | (2006.01) |
| ***B26D 1/00*** | (2006.01) |

(52) U.S. Cl.

CPC ..... *B26D 1/085* (2013.01); *B26D 1/0006* (2013.01); *B26D 5/16* (2013.01); *B41J 11/70* (2013.01); *B41J 29/02* (2013.01); *B26D 2001/006* (2013.01); *B26D 2001/0066* (2013.01); *Y10T 83/04* (2015.04); *Y10T 83/8748* (2015.04); *Y10T 83/8749* (2015.04); *Y10T 83/8785* (2015.04); *Y10T 83/8843* (2015.04); *Y10T 83/8844* (2015.04); *Y10T 83/8854* (2015.04); *Y10T 83/9447* (2015.04); *Y10T 83/9454* (2015.04)

(58) Field of Classification Search

CPC ..... B41J 11/70; B41J 11/703; B41J 11/704; B41J 11/706; B26D 1/0006; B26D 1/085; B26D 5/16; B26D 2001/006; B26D 2001/0066; Y10T 83/8748; Y10T 83/8749; Y10T 83/8785; Y10T 83/8843; Y10T 83/8844; Y10T 83/8854; Y10T 83/9447; Y10T 83/9454

USPC ..... 83/563, 564, 588, 628, 629, 636, 694, 83/697

See application file for complete search history.

(56) References Cited

U.S. PATENT DOCUMENTS

| | | | | |
|---|---|---|---|---|
| 1,447,247 | A * | 3/1923 | Hilsdorf | 83/167 |
| 3,791,248 | A * | 2/1974 | Pearson | 83/641 |
| 4,065,990 | A * | 1/1978 | Edhlund | 83/133 |
| 5,215,393 | A | 6/1993 | Wincent | |
| 5,749,277 | A * | 5/1998 | Walker | 83/563 |
| 6,155,731 | A * | 12/2000 | Bertalan et al. | 400/621 |
| 6,508,600 | B1 * | 1/2003 | Nonaka | 400/621 |
| 7,392,731 | B2 | 7/2008 | Nonaka | |
| 7,404,683 | B2 * | 7/2008 | Mochizuki et al. | 400/613.1 |
| 7,604,426 | B2 * | 10/2009 | Hanaoka et al. | 400/621 |
| 7,857,534 | B2 * | 12/2010 | Watanabe et al. | 400/621 |

(Continued)

OTHER PUBLICATIONS

Star Micronics America, Inc. Brochure: TSP800 High-speed, graphics, reports & receipt printer, 2 pages (2008).

Swecoin U.S. Inc. Brochure: Kiosk Printer, TTP 2000—series, 2 pages (2006).

*Primary Examiner* — Clark F Dexter

(74) *Attorney, Agent, or Firm* — Lipsitz & McAllister, LLC

(57) ABSTRACT

A cutter for a printer is provided, together with corresponding methods. The cutter has a fixed blade and a movable blade. The fixed blade is arranged on a cover bracket. The cover bracket is movable between an open and a closed position. The movable blade is arranged on a printer frame. The movable blade is adapted to move from a home position into engagement with the fixed blade for cutting paper media during a cutting action. In the open position of the cover bracket, the fixed blade and movable blade are separated, enabling paper jams to be cleared and paper to be loaded.

11 Claims, 5 Drawing Sheets

(56) References Cited

U.S. PATENT DOCUMENTS

| | | | | |
|---|---|---|---|---|
| 8,297,864 | B2 * | 10/2012 | Tsugaru et al. | 400/621 |
| 8,439,584 | B2 * | 5/2013 | Hanaoka et al. | 400/621 |
| 8,747,000 | B2 * | 6/2014 | Hanaoka et al. | 400/621 |
| 2003/0198499 | A1 * | 10/2003 | Tsuchiya et al. | 400/621 |
| 2004/0184863 | A1 * | 9/2004 | Mori et al. | 400/621 |
| 2005/0232678 | A1 * | 10/2005 | Mochizuki et al. | 400/621 |
| 2007/0104527 | A1 * | 5/2007 | Watanabe et al. | 400/621 |
| 2010/0043617 | A1 * | 2/2010 | Sato | 83/636 |

* cited by examiner

CUTTER FOR A PRINTER

BACKGROUND OF THE INVENTION

The present invention relates to the field of cutters for printers. More specifically, the present invention relates to guillotine knife blade type cutters for a printer and methods of cutting paper media in a printer using such guillotine knife blades.

High speed printers, such as inkjet, thermal, dye sublimation and dot matrix printers are used to provide vouchers, coupons, tickets, receipts and the like (all generally referred to herein as "tickets") to consumers. Such printers typically use a roll of paper media which is cut by a cutter. Different types of cutters may be used in such printers, including a rotary cutter or a guillotine knife blade type cutter. The guillotine knife cutters typically employ a fixed blade and a movable blade which is displaced in the direction of, and engages against, the fixed blade during a cutting action after the ticket is printed on the paper media. While such guillotine knife blades are generally simpler and less expensive than rotary knife blades, such guillotine knife blades are prone to jamming and difficult to service. It is also typically difficult to load paper into printers having guillotine knife blades.

It would be advantageous to improve the prior art guillotine knife blade type cutters to provide improved serviceability and reliability, and to enable easy loading of paper and clearance of paper jams. It would be advantageous to enable easy separation of the guillotine knife blades for service and jam clearance.

The cutting apparatus and methods of the present invention provide the foregoing and other advantages.

SUMMARY OF THE INVENTION

The present invention relates to a cutter for a printer having guillotine knife blades that are easily separable, along with corresponding methods for cutting paper media using such knife blades.

In one example embodiment of the invention, a cutter for a printer is provided. The cutter comprises a fixed blade and a movable blade. The fixed blade is arranged on a cover bracket. The cover bracket is movable between an open and a closed position. The movable blade is arranged on a printer frame. Means are also provided for moving the movable blade from a home position into engagement with the fixed blade for cutting paper media during a cutting action. In the open position of the cover bracket the fixed blade and movable blade are separated, enabling paper jams to be cleared and paper to be loaded.

The movable blade may be V-shaped, enabling side portions of the movable blade to engage with the fixed blade before a center portion of the movable blade engages with the fixed blade. The fixed blade may be bowed in a center section. For example, the fixed blade may be bowed approximately 0.06 inches in the center section.

The means for moving the movable blade may comprise two spaced apart rotating cams which support and lift the movable blade up into engagement with the fixed blade during the cutting action and a drive mechanism for rotating the two cams simultaneously during the cutting action. Return springs may be provided for biasing the movable blade downward into the home position against the operation of the two cams.

A spring-loaded blade bearing may be provided for biasing the movable blade transverse to a cutting plane against a stop when the cover bracket is in the open position. The stop may be located on the frame.

In one example embodiment, corresponding fingers may be provided which extend off of the fixed blade and the movable blade outside of a cutting width of the blades. The fingers serve to guide the blades into engagement with one another during the cutting action. Further, the corresponding fingers of the fixed blade and the movable blade may engage with one another when the cover bracket is in the closed position and the movable blade is in the home position, ensuring proper alignment for the engagement of the movable blade and the fixed blade during the cutting action.

A sensor may be provided for sensing the home position of the movable blade and which is in communication with the means for moving the movable blade.

The movable blade and the fixed blade may be mounted such that the blades are at a slight angle with respect to one another during the cutting action.

The fixed blade and the movable blade may be coated with different ultra-hard coatings such that a differential hardness between the respective coatings is chosen to focus wear on the fixed blade.

The present invention also includes methods corresponding to the above-described apparatus. An example embodiment of a method for cutting paper media in a printer in accordance with the present invention may comprise: providing a fixed blade arranged on a cover bracket, the cover bracket being movable between an open and a closed position; providing a movable blade arranged on a printer frame; and moving the movable blade from a home position into engagement with the fixed blade for cutting the paper media during a cutting action. In the open position of the cover bracket the fixed blade and movable blade may be separated, enabling paper jams to be cleared and paper to be loaded.

The method embodiments of the present invention may also include various features of the apparatus embodiments discussed above.

BRIEF DESCRIPTION OF THE DRAWINGS

The present invention will hereinafter be described in conjunction with the appended drawing figures, wherein like reference numerals denote like elements, and.

DETAILED DESCRIPTION

The ensuing detailed description provides exemplary embodiments only, and is not intended to limit the scope, applicability, or configuration of the invention. Rather, the ensuing detailed description of the exemplary embodiments will provide those skilled in the art with an enabling description for implementing an embodiment of the invention. It should be understood that various changes may be made in the function and arrangement of elements without departing from the spirit and scope of the invention as set forth in the appended claims.

The present invention relates to a cutter for a printer having guillotine knife blades that are easily separable, along with corresponding methods for cutting paper media using such knife blades.

Figure 1:
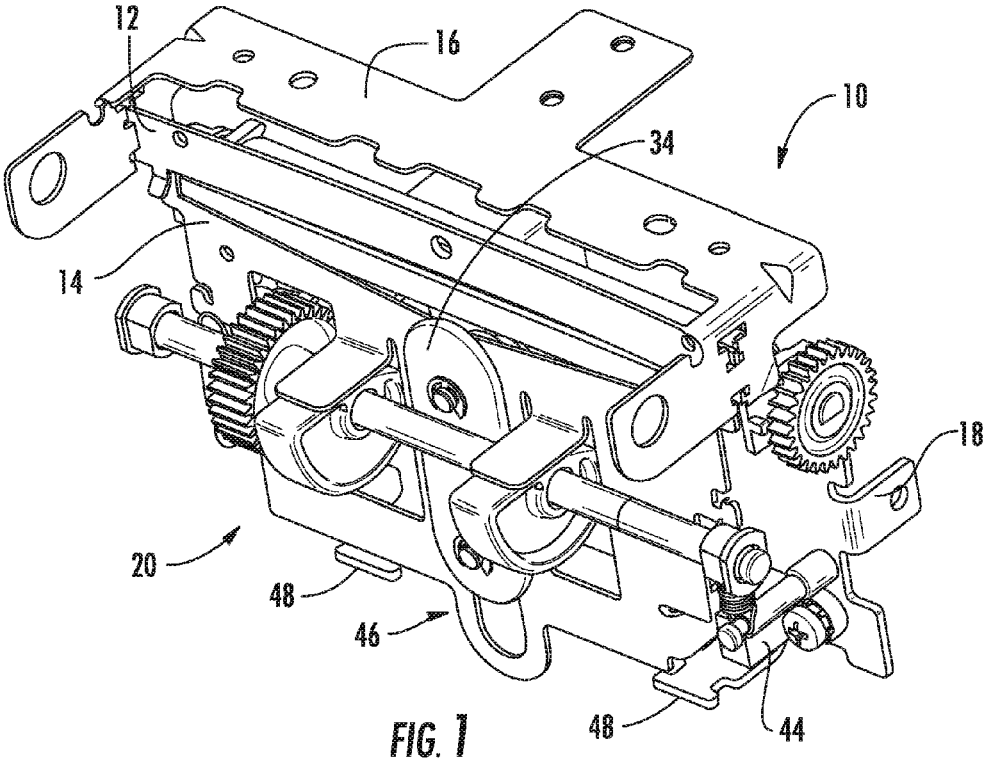
FIG. 1 shows an example embodiment of a cutter for a printer in accordance with the present invention.

An example embodiment of a cutter 10 for a printer in accordance with the present invention is shown in FIG. 1. The cutter 10 comprises a fixed blade 12 and a movable blade 14. The fixed blade 12 is arranged on a cover bracket 16. The cover bracket 16 is movable between an open and a closed position. A cover (not shown for clarity) may be attached to the movable cover bracket 16. The movable blade 14 is arranged on a printer frame 18. The printer frame 18 may house the printer mechanism (not shown for clarity). Means 20 are also provided for moving the movable blade 14 from a home position (as shown in FIG. 1) into engagement with the fixed blade 12 for cutting paper media during a cutting action.

Figure 2:
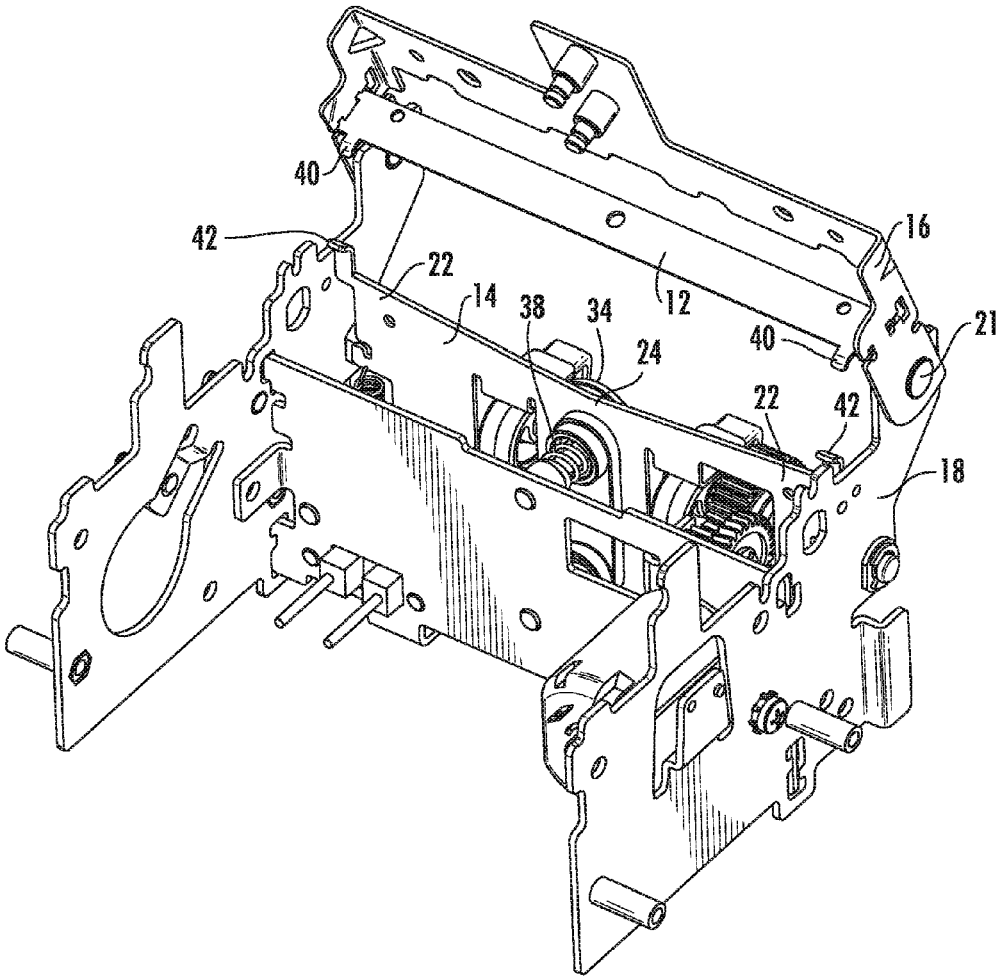
FIG. 2 shows an example embodiment of a cutter for a printer arranged on a printer frame in accordance with the present invention, with a cover bracket in an open position.

FIG. 1 shows the cover bracket 16 in the closed position. FIG. 2 shows an example embodiment of the present invention with the cover bracket 16 in the open position. In the open position of the cover bracket 16, the fixed blade 12 and movable blade 14 are separated, enabling paper jams to be cleared and paper to be loaded.

The cover bracket 16 may be pivotally connected to the printer frame 18 for pivoting between the open and closed positions, for example at pivot point 21 as shown in FIG. 2.

Figure 3:
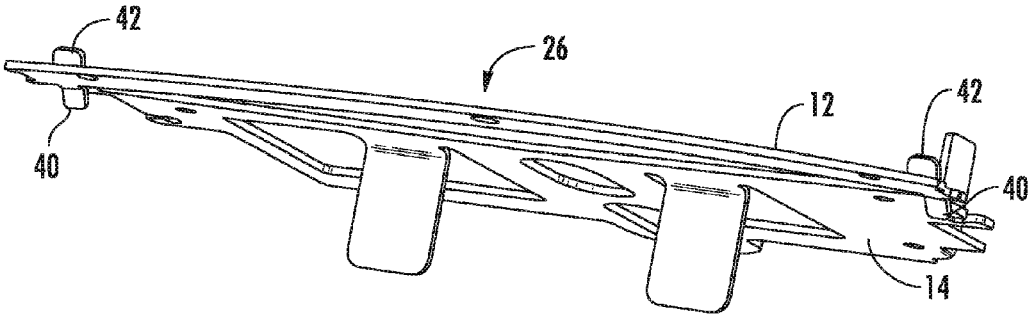
FIG. 3 shows an example embodiment of a fixed blade and a movable blade of the cutter in accordance with the present invention.

The movable blade 14 may be V-shaped, enabling side portions 22 of the movable blade 14 to engage with the fixed blade 12 before a center portion 24 of the movable blade 14 engages with the fixed blade 12. As shown in FIG. 3, the fixed blade 12 may be bowed in a center section 26. For example, the fixed blade 12 may be bowed approximately 0.06 inches in the center section 26.

Figure 4:
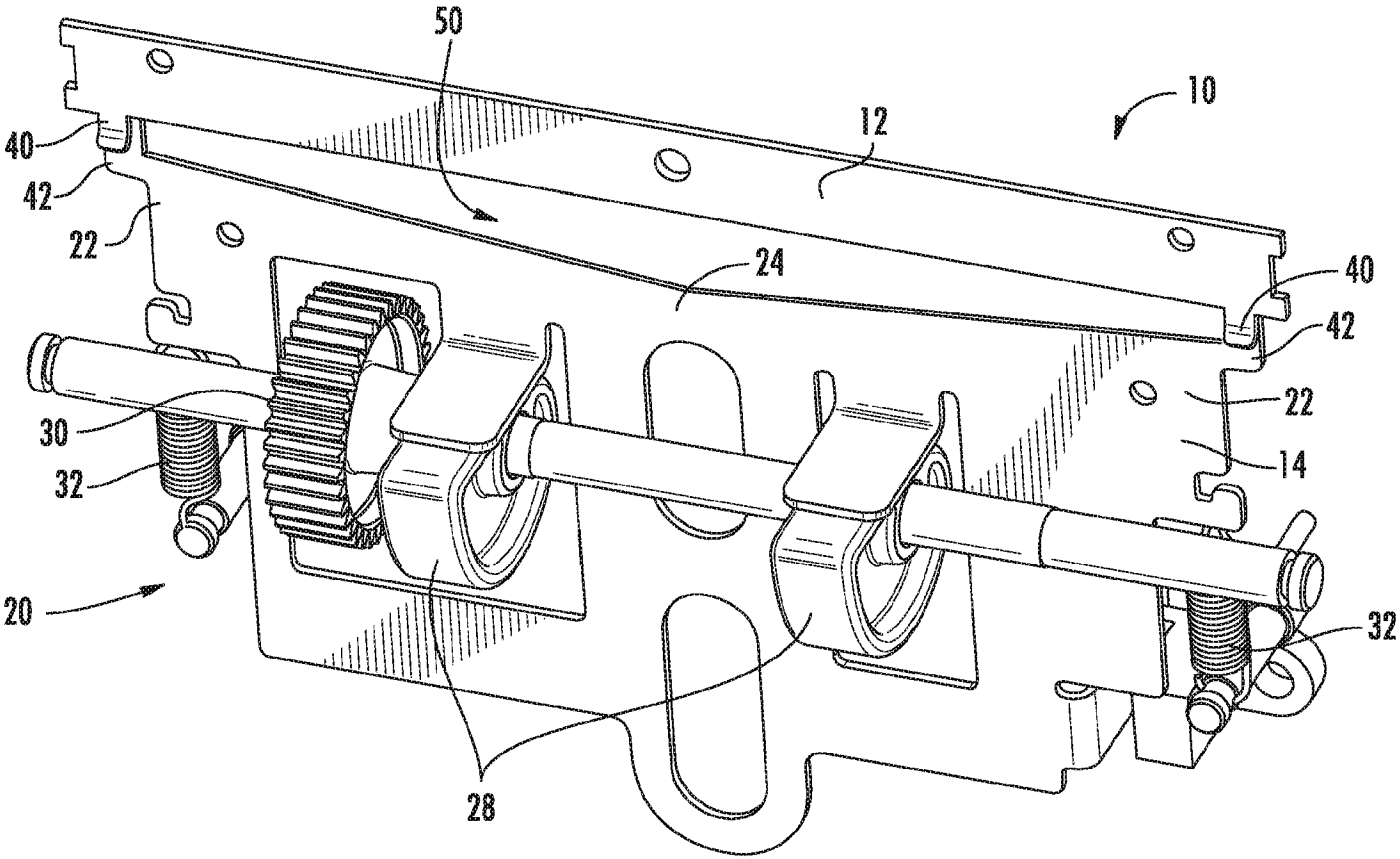
FIG. 4 shows an example embodiment of a means for moving the movable blade in accordance with the present invention.

As can be seen from FIG. 4, the means 20 for moving the movable blade 14 may comprise two spaced apart rotating cams 28 which support and lift the movable blade 14 up into engagement with the fixed blade 12 during the cutting action and a drive mechanism 30 for rotating the two cams 28 simultaneously during the cutting action. The use of two spaced apart cams 28 provides a smoother cutting action resulting in a more even cut than would otherwise be obtainable. Alternate means of moving the movable blade are also within the scope of the present invention, including but not limited to use of a single cam, multiple cams, a rotary arm attached to one or more cams, a solenoid attached to one or more cams, a rack and pinion arrangement, linkage connecting the movable blade to a rotating disk (e.g., a Scotch yoke), or the like.

Return springs 32 may be provided for biasing the movable blade 14 downward into the home position against the operation of the two cams 28.

Figure 5:
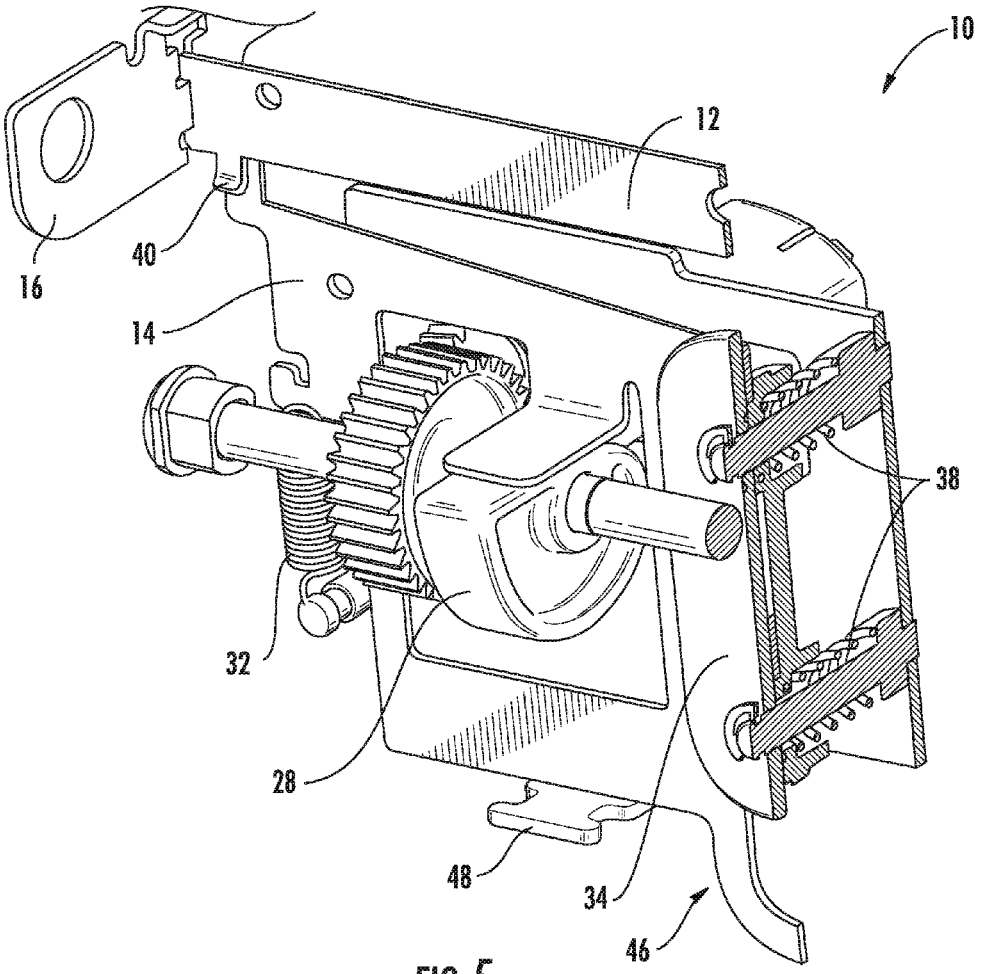
FIG. 5 shows a cross-section taken through the middle of the cutter shown in FIG. 1, in accordance with an example embodiment of the present invention.
Figure 6:
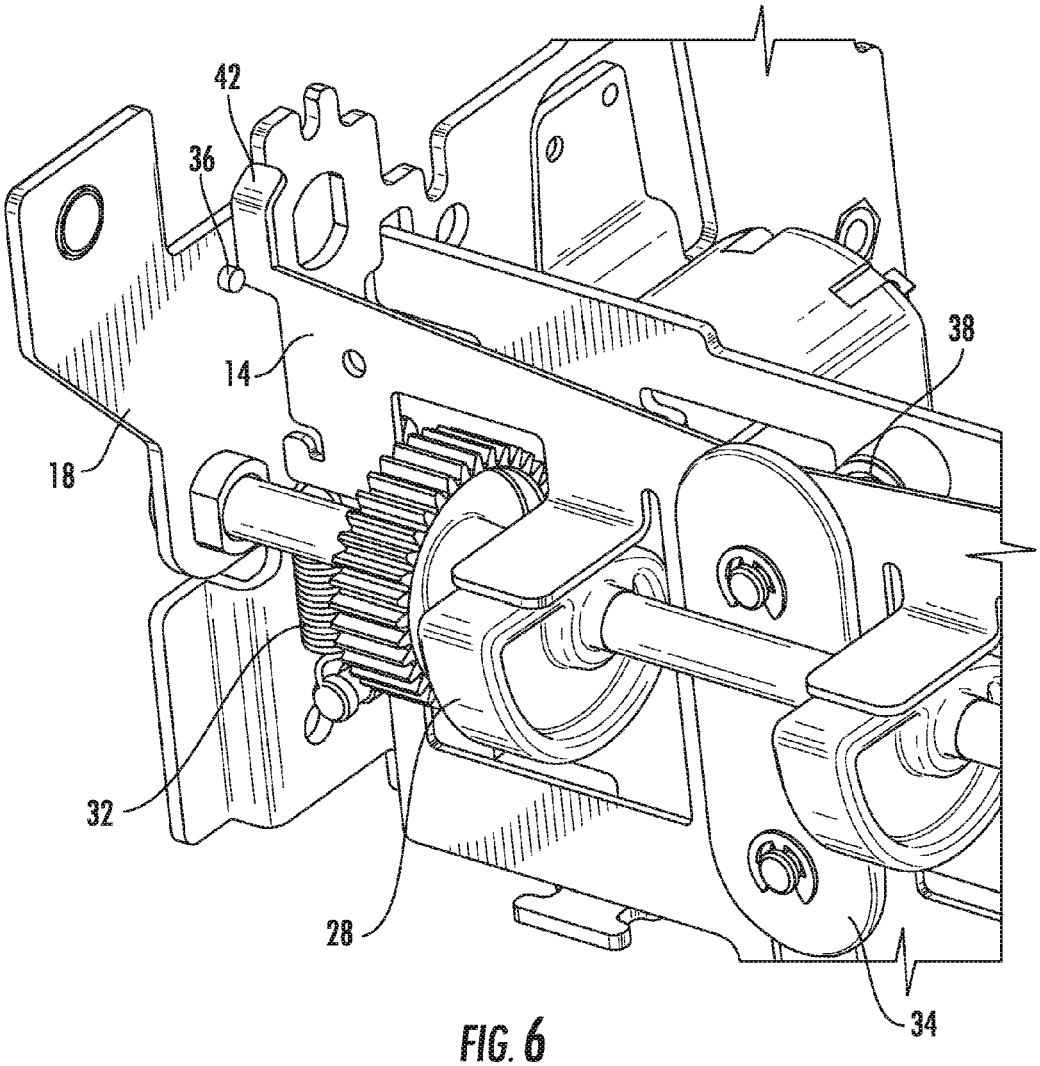
FIG. 6 shows an enlarged detail of a portion of the cutter shown in FIG. 2, in accordance with an example embodiment of the present invention.

FIG. 5 shows a cross-section through the middle of cutter 10 and FIG. 6 shows a detailed view of a portion of the cutter 10. As can be seen in detail from FIGS. 5 and 6, a spring-loaded blade bearing 34 may be provided for biasing the movable blade 14 transverse to a cutting plane against a stop 36 when the cover bracket 16 is in the open position. Springs 38 provide the biasing force for the blade bearing 34. The stop 36 may be located on the frame 18. Two stops 36 may be provided, one on either side of the frame 18.

In one example embodiment, corresponding fingers 40, 42 may be provided which extend off of the fixed blade 12 (fingers 40) and off of the movable blade 14 (fingers 42). The fingers 40, 42 are positioned outside of a cutting width of the blades 12, 14. The fingers 40, 42 serve to guide the blades 12, 14 into engagement with one another during the cutting action.

The corresponding fingers 40, 42 of the fixed blade 12 and the movable blade 14 may engage with one another when the cover bracket 16 is in the closed position and the movable blade 14 is in the home position, ensuring proper alignment for the engagement of the movable blade 14 and the fixed blade 12 during the cutting action. The home position of the movable blade 14 when the cover bracket 16 is closed is shown, for example, in FIG. 4. As can be seen from FIG. 4, when the cover bracket is closed, the corresponding fingers 40, 42 engage against one another while the cutting portion of the blades remain separated, forming part of the paper path 50 therebetween.

When the cover bracket 16 is opened and the movable blade 14 returns to an unengaged position (i.e., fingers 40 and 42 are no longer in engagement with one another), the movable blade 14 may be located by the blade bearing 34. The stops 36 prevent the movable blade 14 from being able to freely pivot about the blade bearing 34. These stops 36 may comprise two small protrusions off of the sides of the frame 18 to limit the pivoting of the movable blade 14 and allow for better control when closing the cover bracket 16 and re-engaging the fingers 40, 42 of blades 12 and 14.

A sensor 44 may be provided for sensing the home position of the movable blade 14. The sensor 44 may be in communication with the means for moving the movable blade 14. The sensor 44 may comprise an optical sensor.

The movable blade 14 and the fixed blade 12 may be mounted such that the blades are at a slight angle with respect to one another during the cutting action.

The fixed blade 12 and the movable blade 14 may be coated with different ultra-hard coatings such that a differential hardness between the respective coatings is chosen to focus wear on the fixed blade 12.

In operation of an example embodiment of the cutter 10, when the cover bracket 16 is closed, the movable blade 14 resides in the home position as shown in FIG. 4, with its fingers 42 engaged with the fingers 40 of the fixed blade 12. Upon commencement of the cutting action, the cams 28 will rotate causing the movable blade 14 to be raised upward towards the fixed blade 12. The V-shape of the movable blade 14 enables the side portions 22 to engage with the fixed blade 12 prior to the center portion 24 of the movable blade engaging with the fixed blade 12 during the cutting action. Due to the bow in the center section 26 of the fixed blade (see, e.g., FIG. 3), the side portions 22 of the movable blade 14 are raised off of the fixed blade 12 as the movable blade 14 rises to complete the cutting action (i.e., as the center portion 24 of the movable blade 14 comes into contact with the bowed portion 26 of the fixed blade 12), allowing the blade bearing 34 to deliver pressure against cutting points on either side of the knife blades equally during the cutting action. The cams 28 continue to rotate, allowing the movable blade 14 to lower. The return springs 32 pull the movable blade 14 back down into the home position where the movable blade is sensed by the sensor 44, signaling a control system (not shown) to stop the cams 28 from rotating further, leaving the movable blade 14 in the home position.

In order to ensure edge-to-edge contact of the blades 12, 14 during the cutting action, a tail section 46 of the movable blade 14 is supported at a rear portion 48 of the frame 18 while the cutting edge of the movable blade 14 is position on the fixed blade 12 (which at this point is resting and bowed against the frame 18.) This creates a slight angle between the blades 12, 14 which ensures that the blade cutting edges are in contact during the cut.

It should now be appreciated that the present invention provides improved guillotine knife blade type cutters and corresponding methods.

Although the invention has been described in connection with various illustrated embodiments, numerous modifications and adaptations may be made thereto without departing from the spirit and scope of the invention as set forth in the claims.

What is claimed is:

1. Cutter of a printer, comprising:

a fixed blade arranged on a cover bracket, said cover bracket being pivotally connected to a printer frame and movable between an open position and a closed position;

a movable blade arranged on the printer frame;

means for moving the movable blade from a home position into engagement with the fixed blade for cutting paper media during a cutting action;

a sensor for sensing the home position of the movable blade, the sensor being in communication with the means for moving the movable blade;

a spring-loaded blade bearing centered on the movable blade, the spring-loaded blade bearing biasing the movable blade transverse to a cutting plane against two stops when the cover bracket is in the open position, the stops protruding laterally from oppositely disposed sides of the printer frame, and the spring-loaded blade bearing biasing a cutting edge of the movable blade against the fixed blade when the cover bracket is in the closed position; and a rear frame portion of the printer frame adapted to support a tail section of the movable blade, the tail section being located at an opposite end of the movable blade from the cutting edge such that, when the cutting edge of the movable blade is biased against the fixed blade by the spring-loaded blade bearing, the fixed blade and the movable blade are angled towards one another;

wherein in the open position of the cover bracket, the fixed blade and movable blade are separated, enabling paper jams to be cleared and paper to be loaded.

2. A cutter in accordance with claim 1, wherein the movable blade is V-shaped, enabling side portions of the movable blade to engage with the fixed blade before a center portion of the movable blade engages with the fixed blade.

3. A cutter in accordance with claim 2, wherein the fixed blade is bowed in a center section.

4. A cutter in accordance with claim 3, wherein the fixed blade is bowed approximately 0.06 inches in the center section.

5. A cutter in accordance with claim 1, wherein said means for moving the movable blade comprises:

two spaced apart rotating cams which support and lift the movable blade up into engagement with the fixed blade during the cutting action; and a drive mechanism for rotating the two cams simultaneously during the cutting action.

6. A cutter in accordance with claim 5, further comprising:

return springs for biasing the movable blade downward into the home position against the operation of the two cams.

7. A cutter in accordance with claim 1, further comprising:

corresponding fingers extending off of the fixed blade and the movable blade outside of a cutting width of the blades for guiding the blades into engagement with one another during the cutting action.

8. A cutter in accordance with claim 7, wherein the corresponding fingers of the fixed blade and the movable blade engage with one another when the cover bracket is in the closed position and the movable blade is in the home position, ensuring proper alignment for the engagement of the movable blade and the fixed blade during the cutting action.

9. A cutter in accordance with claim 1, wherein the movable blade and the fixed blade are angled towards one another during the cutting action.

10. A cutter in accordance with claim 1, wherein:

the fixed blade and the movable blade are coated with different ultra-hard coatings; and a differential hardness between the respective coatings is chosen to focus wear on the fixed blade.

11. A cutter in accordance with claim 1, wherein the means for moving the movable blade comprises a drive mechanism for the movable blade disposed on the printer frame.

* * * * *